United States Patent [19]

Renaud et al.

[11] 4,101,456

[45] Jul. 18, 1978

[54] LIGHT DUTY LIQUID DETERGENT

[75] Inventors: Jean Renaud, Bougival; Gilles Noiriel, Rueil-Malmaison; Georges Chazard, Bezons, all of France

[73] Assignee: Colgate-Palmolive Company, New York, N.Y.

[21] Appl. No.: 674,788

[22] Filed: Apr. 8, 1976

[30] Foreign Application Priority Data

Apr. 18, 1975 [GB] United Kingdom ..... 16108/75

[51] Int. Cl.[2] ..... C11D 1/37; C11D 1/62; C11D 3/26

[52] U.S. Cl. ..... 252/551; 252/153; 252/542; 252/546; 252/547; 252/552; 252/553; 252/554; 252/555; 252/558; 252/DIG. 2; 252/DIG. 15

[58] Field of Search ..... 252/153, 528, 547, 551, 252/552, 553, 554, 558, DIG. 2, DIG. 14, DIG. 15, 542, 546

[56] References Cited

U.S. PATENT DOCUMENTS

| | | | |
|---|---|---|---|
| 3,313,734 | 4/1967 | Lang et al. | 252/547 X |
| 3,472,840 | 10/1969 | Stone et al. | 260/231 |
| 3,496,109 | 2/1970 | Walker et al. | 252/106 |
| 3,580,853 | 5/1971 | Parran | 252/547 |
| 3,726,815 | 4/1973 | Grand | 252/544 |
| 3,812,042 | 5/1974 | Verdier | 252/90 |
| 3,816,616 | 6/1974 | Anguillo et al. | 424/70 |
| 3,917,817 | 11/1975 | Vanlerberghe et al. | 424/70 |
| 3,928,249 | 12/1975 | Nunziata et al. | 252/526 |
| 3,944,663 | 3/1976 | Weiss et al. | 424/78 |
| 3,963,649 | 6/1976 | Spadini et al. | 252/546 |
| 3,980,769 | 9/1976 | Ghilardi et al. | 424/70 |

FOREIGN PATENT DOCUMENTS

| | | |
|---|---|---|
| 2,361,081 | 6/1974 | Fed. Rep. of Germany. |
| 1,443,959 | 7/1976 | United Kingdom. |

*Primary Examiner*—P.E. Willis, Jr.
*Attorney, Agent, or Firm*—Richard N. Miller; Murray M. Grill; Herbert S. Sylvester

[57] ABSTRACT

This invention relates to a method of cleaning articles of glass or having glazed surfaces (including vitreous enamel) and to detergent compositions which are particularly suitable for use in cleaning such articles. Examples of such detergent compositions are hand dishwashing liquids and powders, machine dishwashing detergents and rinse aids, window cleaning compositions and all purpose cleansers.

12 Claims, No Drawings

LIGHT DUTY LIQUID DETERGENT

This invention relates to a method of cleaning articles of glass or having glazed surfaces (including vitreous enamel) and to detergent compositions which are particularly suitable for use in cleaning such articles. Examples of such detergent compositions are hand dishwashing liquids and powders, machine dishwashing detergents and rinse aids, windows cleaning compositions and all purpose cleansers.

Aqueous media containing conventional types of dishwashing detergent compositions, rinse aids and the like, used for washing or rinsing articles of glass or having glazed surfaces are often found to drain unevenly from the surfaces of the articles. If the articles are not wiped but are allowed to dry by draining and evaporation, the surfaces are often found to be spotted with traces of solid matter.

It is an object of the invention to provide detergent compositions such that aqueous media containing the compositions drain evenly from glass or glazed surfaces washed therewith and rinsed, and leave the surfaces substantially spot-free without wiping.

A further object is to provide a method of cleaning such articles which does not involve wiping and which leaves the surfaces of the articles substantially spot-free.

According to one aspect of the invention a method of cleaning articles having soiled glazed surfaces comprises washing the articles in an aqueous medium containing a water-soluble detersive surface-active agent or, preferably, a mixture of such surface-active agents, and a water-soluble non-proteinaceous cationic polymer, the medium being devoid of added water-insoluble particulate solids. The concentration of the surfaceactive agent in the aqueous medium will usually be in the range of about .01% to about 1%, preferably from 0.03% to 0.3%, by weight and the weight ratio of the surface-active agent to the polymer will be from about 2:1 to about 1000:1, preferably from about 15:1 to about 100:1. In performing the method of this invention it is preferred to rinse the articles with water between washing with said aqueous medium and draining.

Preferably the water-soluble non-proteinaceous cationic polymer is a cationic high molecular weight cellulose derivative having repeating units of the formula (I):

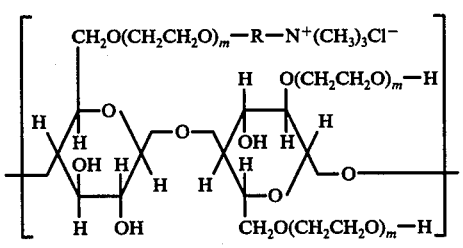

(I)

wherein R is an alkylene group, e.g. a methylene or ethylene group, or a hydroxy substituted alkylene group, e.g., 2-hydropropylene, $m$ is zero or a small integer, e.g., 1 or 2, and $n$ is the number of repeating units. Suitable polymers are described, for example, in British Pat. specification No. 1166062, the disclosure of which is incorporaated herein by reference, wherein the cellulose ethers are described as being polymers of the structural formula:

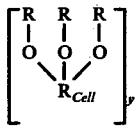

wherein $R_{Cell}$ is the residue of an anhydroglucose unit, $y$ is an integer having a value from 50 to 20,000, and each R individually represents a substituent group of the general formula:

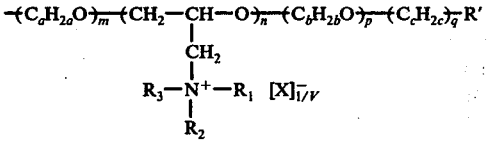

wherein $a$ is 2 or 3; $b$ is 2 or 3; $c$ is 1, 2 or 3; $m$ is 0 or an integer from 1 to 10; $n$ is 0, 1, 2, or 3; $p$ is 0 or an integer from 1 to 10; $q$ is 0 or 1; R' is H,

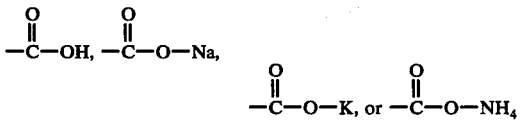

with the proviso that when q is 0 than R' then R' is H;

$R_1$, $R_2$ and $R_3$ taken individually represent alkyl, aryl, aralkyl, alkaryl, cycloalkyl, alkoxyalkyl or alkoxyaryl radicals containing up to 10 carbon atoms, with the proviso that when any one of them is an alkoxyalkyl radical there are least 2 carbon atoms separating the oxygen atom from the nitrogen atom, with the further proviso that the total number of carbon atoms in $R_1$, $R_2$ and $R_3$ is from 3 to 12 and with the further proviso that when $R_1$, $R_2$ and $R_3$ are taken together, the nitrogen atom to which $R_1$, $R_2$ and $R_3$ are attached can be a component of a heterocyclic ring selected from pyridine, 2-methylpyridine, 3,5-dimethylpyridine, 2,4,6-trimethylpyridine, N-methylpiperidne, N-ethylpiperidine, N-methylmorpholine and N-ethylmorpholine;

X is an anion;

V is an integer which is equal to the valence of X; the average value of n per anhydroglucose unit of said cellulose ether is from 0.01 to about 1 and preferably from about 0.1 to about 0.5; and the average value of m+n+p+q per anhydroglucose unit of said cellulose ether is from 0.01 to 4, preferably from 0.1 to 2.5 and most preferably from 0.8 to 2. Commercially available examples of such polymers are those sold by Union Carbide as "Polymer JR Resins". Three different grades are currently available, differing in their molecular weights. Their characteristics are as follows:

TABLE I

| | JR - 125 | JR - 400 | JR - 30M |
|---|---|---|---|
| Viscosity, cps, at 25° C (2wt%) aqueous solution, Brookfield LVT, No. 1 Spindle, 30 rpm | 60 - 150 | 300 - 500 | (1% solution) 1000 - 2500 |
| Percent Volatiles as packaged | 6.0 max | 6.0 max | 6.0 max |
| Percent water insoluble | 0.5 max | 0.5 max | 1.0 max |
| Percent Ash (as NaCl) | 2.0 max | 2.0 max | 2.0 max |
| Percent Nitrogen | 1.7 - 2.2 | 1.7 - 2.2 | 1.7 - 2.2 |

TABLE I-continued

| | JR - 125 | JR - 400 | JR - 30M |
|---|---|---|---|
| Particle Size : % through 20 mesh | 95 min | 95 min | 95 min |
| Particle Size : % through 40 mesh | 85 min | 85 min | 85 min |
| Molecular weight | 400,000 | 600,000 | 1,000,000 |

In performing the method of the invention it is preferred to rinse the articles with water at temperatures of from 20° C to 60° C between the step of washing with said aqueous medium at a temperature of from 20° C to 50° C and the step of draining.

According to a further aspect of the invention a dishwashing liquid detergent composition is provided for use in the foregoing method which is free of water-insoluble particulate solids and comprises a water-soluble detersive surface-active agent or, preferably, a mixture of such agents and a water-soluble non-proteinaceous cationic polymer. The polymer may be, for instance, a high molecular weight cellulose derivative having repeating units of formula (I) above, and is preferably one of the abovementioned "polymer JR Resins".

It has been found that glass articles or articles having glazed surfaces when cleaned by the method or compositions of the invention, rinsed and left to dry, dry virtually spot-free. Such articles are believed to have active negative sites dispersed randomly over their surfaces and it is believed that these sites and the cationic polymers coact to cause the film of the said aqueous medium left from the washing and rinsing operations to shrink rapidly and hence leave no unsightly spots or deposits on the dry surface. When surfaces lacking these random negative sites are so washed, the film still drains quickly but drains down in the normal way without the above dscribed shrinking.

Previous attempts to achieve this end have been made using gelatin-containing detergent compositions. The use of the non-proteinaceous cationic polymers in place of gelatin has been found to be advantageous in both offering better results particularly in soft water, and in that the compositions of the present invention have better storage properties, especially at low temperatures. It will be appreciated that compositions such as detergents will normally be stored in concentrated form and diluted, usually with water, for use. Furthermore, the Bloom value, defined as the ability of a material to form a gel and measured in Bloom or Bloom grams on apparatus known as a Bloom-gel-O-meter of the JR Resins is essentially zero. The molecular weight of the JR Resins is important. If the molecular weight is too low the composition according to the present invention may not spread adequately over the surface of an article to be cleaned. If the molecular weight is too high, although aqueous media containing the compositions have good spreading properties, the compositions may be too viscous, particularly at low temperatures, for convenient use. Therefore a medium molecular weight offers the best compromise.

Attempts to formulate compositions such as described above using other non-polymeric cationic high molecular weight materials, such as cationic starch, in place of the cationic non-proteinaceous polymers used herein were not successful.

The water-soluble detersive surface-active agents used in the compositions employed in the foregoing method may be any of those conventionally used, or suitable for use, in a liquid detergent product intended for use for cleaning hard surfaces, and which are compatible with the cationic non-proteinaceous polymers. Some anionic detergent is necessary to give sufficient foaming, which although not essential to the performance plays an important part in consumer acceptability of such products. It is desirable that some nonionic detergent is also present to assist in maintaining viscosity at a useful level, although nonionics generally do not have the required foaming properties.

Among the detergents which may be used are anionic detergents including higher $C_8$–$C_{20}$) alkyl mononuclear aromatic sulphonates, such as higher alkyl benzene sulphonates containing from 10 to 16 carbon atoms in the higher alkyl group in a straight or branched chain, preferably a straight chain, for example, the sodium, potassium and ammonium salts of various acids to result in higher alkyl benzene sulphonates, higher alkyl toluene sulphonates, higher alkyl phenol sulphonates and higher naphthalene sulphonates; $C_{12}$–$C_{18}$ olefin sulphonates, preferably alpha-olefin sulphonates; paraffin sulphonates containing 10 to 20 carbon atoms, for example the primary paraffin sulphonates made by reacting long-chain alphaolefins and bisulphites and paraffin sulphonates having sulphonate groups distributed along the paraffin chain; alkane sulphates such as sodium and potassium sulphates of higher alcohols containing 8 to 18 carbon atoms, e.g., sodium lauryl sulphate and sodium tallow alcohol sulphate; sodium and potassium salts of alpha-sulpho-fatty acid esters containing 10 to 20 carbon atoms in the acyl groups, for example, methyl alpha-sulpho-myristate and methyl alpha-sulphotallowate; ammonium sulphates of monoor diglycerides of higher $C_8$–$C_{18}$ fatty acids, for example, stearic monoglyceride mono-sulphate; sodium higher alkyl glyceryl ether sulphonates; sodium and potassium alkyl phenol polyethenoxy ether sulphates having 1 to 6 ethoxyethylene groups per molecule and in which the alkyl radicals contain 8 to 12 carbon atoms; and sodium, potassium or ammonium $C_{12}$–$C_{15}$ alkyl polyethenoxy ether sulfates having 1 to 5 ethenoxy groups in the molecule.

Other suitable anionic detergents include the $C_8$ to $C_{18}$ acyl sarcosinates, e.g., sodium lauroyl sarcoside; sodium and potassium salts of the reaction product of higher fatty acids containing 8 to 18 carbon atoms in the molecule esterified with isethionic acid; and sodium and potassium salts of the $C_8$ to $C_{18}$ acyl N-methyl taurate and potassium stearol methyl taurate.

Nonionic detergents which may be used are the nonionic synthetic organic detergents which are generally the condensation products of an organic aliphatic or alkyl aromatic hydrophobic compound and hydrophilic ethylene oxide groups. Almost any hydrophobic compound having a carboxy, hydroxy, amido or amino group with a free hydrogen attached to the nitrogen can be condensed with ethylene oxide, its hydration product, polyethylene glycol, and sometimes with a minor proportion of propylene oxide also, to form a nonionic detergent. Further, the length of the polyethenoxy chain can be adjusted to achieve the desired balance between the hydrophobic and hydrophilic portions.

The nonionic detergents include the polyethylene oxide condensates of one mol of alkyl phenol, containing from 6 to 12 carbon atoms in a straight- or branched-chain configuration, with 5 to 30 mols of ethylene oxide; for example, nonyl phenol condensed with 9 mols of ethylene oxide, dodecyl phenol condensed with 15 mols of the oxide and dinonyl phenol condensed with 15 mols of ethylene oxide. Condensation products of the corresponding alkyl thiophenols with 5 to 30 mols of ethylene oxide are also suitable.

Also included in the nonionic detergent class are the condensation products of a higher alcohol containing 8 to 18 carbon atoms in a straight or branched chain configuration with 5 to 30 mols of ethylene oxide, for example, a mol of mixed lauryl and myristyl alcohols condensed with about 16 mols of ethylene oxide.

A very useful group of nonionics is marketed in the U.S.A. under the trade name "pluronic" (PLURONIC is a trade mark). Such compounds are formed by condensing ethylene oxide with a hydrophobic base formed by the condensation of propylene oxide with propylene glycol. The molecular weight of the hydrophobic portion of the molecule is generally in the range from 950 to 4,000, preferably 1,200 to 2,500. The addition of polyoxyethylene radicals to the hydrophobic portion tends to increase the solubility of the molecule as a whole. The molecular weight of these block copolymers may be from 1,500 to 15,000, and the polyethylene oxide content may constitute 20% to 80% thereof.

The polar nonionic detergents are those in which the hydrophilic groups contains a semi-polar bond directly between two atoms, for example, N →O, As →O, and S →O. There is charge separation between the two directly bonded atoms, but the detergent molecule bears no net charge and does not dissociate into ions. Among the polar nonionic detergents are open-chain aliphatic amine oxides of the general formula $$R_1R_2R_3N \rightarrow O \qquad \text{(II)}$$

wherein $R_1$ is an alkyl, alkenyl or monohydroxyalkyl radical having 10 to 18 carbon atoms, and $R_2$ and $R_3$ are each selected from methyl, ethyl, propyl, ethanol and propanol radicals. A preferred example is myristyl dimethyl amine oxide. Other suitable polar nonionic detergents are the open-chain aliphatic phosphine oxides having the general formula $$R_1R_2R_3P \rightarrow O \qquad \text{(III)}$$

analogous to the amine oxides described above. The amine and phosphine oxides may be considered to be foaming agents, stabilizers and boosters, in addition to having detersive and other surface active properties.

Zwitterionic detergents may be used, such as the betaines and sulphobetaine having the following formula

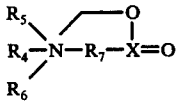

(IV)

wherein $R_4$ is an alkyl group containing 8 to 18 carbon atoms, $R_5$ and $R_6$ are each an alkyl or hydroxyalkyl group containing 1 to 4 carbon atoms, $R_7$ is an alkylene or hydroalkylene group containing 1 to 4 carbon atoms, $R_7$ is an alkylene or hydroalkylene group containing 1 to 4 carbon atoms, and X is C or S:O. The alkyl group $R_4$ can contain one or more intermediate linkages such as amido, ether or polyether linkages or nonfunctional substituents such as hydroxyl or halogen which do not substantially affect the hydrophobic character of the group. When X is C, the detergents is called a betaine and when X is S:O the detergent is called a sulphobetaine or sultaine. Preferred betaine and sulphobetaine detergents are 1-(lauryl dimethylammonio) acetate, 1-(myristyl dimethylammonio) propane-3-sulphonate and 1-(myristyldimethylammonio)-2-hydroxypropane-3-sulphonate.

Examples of ampholytic detergents which may be used include the alkyl beta-aminopropionates, $$R_8N(H)C_2H_4\,COOM \qquad \text{(V)}$$

and the long chain imidazole derivatives having the following formulae

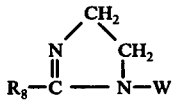

(VI)

and

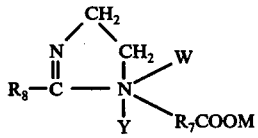

(VII)

wherein $R_7$ is as defined above, $R_8$ is an acyclic group of 7 to 18 carbon atoms, W is $R_7OH$, $R_7COOM$, or $R_7OR_7COOM$, Y is OH or $R_9SO_3$ wherein $R_9$ is an alkyl, alkyl aryl or fatty acyl glyceride group having 6 to 18 carbon atoms in the alkyl or acyl group, and M is a water-solubilizing cation, for example, sodium, potassium, ammonium or alkylolammonium.

Formula VI detergents are disclosed in Volume II of the textbook "Surface Active Agents and Detergents" by Scwartz, Perry and Berch, (1958), published by Interscience Publishers. The acyclic groups $R_8$ may be derived from coconut oil fatty acids (a mixture of fatty acids containing 8 to 18 carbon atoms but principally lauric, myristic and palmitic acids), lauric acid, and oleic acid, and the preferred groups are $C_7$ to $C_{17}$ alkyls. Preferred ampholytic detergents are sodium N-lauryl betaamino-propionate, disodium N-lauryl iminodipropionate and the disodium salt of 2-lauryl-cycloimidium-1-hydroxyl, 1-ethoxyethanoic acid, 1-ethanoic acid.

The said textbook provides descriptions of a number of further suitable detergents.

The anionic and amphoteric detergents generally will be employed in the form of a salt and such salt will be suitably selected based upon the particular formulation and the proportions therein suitable salts include the ammonium, substituted ammonium (mono-, di-, and triethanolammonium), and alkali metal (such as sodium and potassium) salts. Preferred anionic detergent salts are the ammonium, triethanolammonium, sodium and potassium salts.

Mixtures of the above-exemplified detergents in any suitable proportions may be used in the described method. However, the preferred liquid dishwashing compositions comprise a mixture of linear $C_{10}$–$C_{16}$ alkyl benzene sulfonate or $C_{12}$–$C_{18}$ $\alpha$ olefin sulfonate or $C_{10}$–$C_{20}$ paraffin sulfonate with a second detergent selected from the group consisting of $C_{12}$–$C_{15}$ alkyl polyethenoxy (1–5) ether sulfate, $C_{8-C12}$ alkylphenol polyethenoxy (1–6) ether sulfate, condensation products of 5 to 30 moles of ethylene oxide with either $C_8$–$C_{15}$ alkanol or $C_8$–$C_{12}$ alkylphenol and mixtures thereof. The weight ratio of the sulfonate detergent to the second recited detergent in the detergent mixture will usually be in the range of about 1:4 to 4:1, preferably 1:2 to 2:1. Most preferably, the detergent mixture will include a $C_{12}$–$C_{15}$ alkyl triethenoxy ether sulfate detergent in a major proportion because high concentrations of sulfonate detergent appear to reduce the effectiveness of the polymer.

Various adjuvants and additional components may be employed for specific purposes, such as a $C_2$–$C_3$ alcohol, preferably ethanol, as a viscosity reducer and solubilizer and a hydrotrope as a solubilizer. Both the alcohols and the hydrotropes help to make the compositions clear and attractive looking. Alcohols are usually present in the preferred dishwashing liquid compositions. These are in some ways complementary to the non-ionic detergent content (if present). Urea, normally employed as the technical product, may be used as a viscosity control agent. Additional foam boosters may be used, such as $C_8$–$C_{18}$ fatty acid mono- and di-ethanolamides and $C_{10}$–$C_{18}$ alkyl amine oxides in amounts of 1% to 8% by weight among other adjuvants may be mentioned perfume; preservatives such as formaldehyde to protect the polymers (particularly the JR Resins) from bacterial attack; pH adjusters and buffers; sequestrants to clarify the compositions by sequestering hardness ions or other materials that could form insoluble flocculant precipitates of color bodies in the detergents; emollients; bactericides; fungicides; antioxidants; stabilizers; enzymes; coloring agents such as watersoluble dyes; emulsifiers; fluorescent brighteners; and lanolin derivatives and other skin conditioning fats and oils.

Builder salts may also be added. These builder salts may be silicates, carbonates, phosphates, (including tripolyphosphate and pyrophosphates), bicarbonates and borates, preferably as the alkalimetal or ammonium salts, e.g., sodium, potassium and amonium salts of the above types, including tetrapotassium pyrophosphate, pentasodium tripolyphosphate, sodium silicates of an $Na_2O:SiO_2$ ratio in the range of from 1:1.6 to 1:2.8, especially 1:2.0 to 1:2.6, and ammonium phosphate. However, builder salts are often considered to be harsh on the hands or environmentally undesirable and so generally will only be employed in small proportions or not at all in dishwashing detergent compositions.

The compositions may contain from 0.05 to 5%, preferably 0.1 to 3%, e.g., about 0.4 or 0.5 or 0.6% or 1.5%, by weight of the cationic non-proteinaceous polymer, e.g., the JR Resin, when used, preferably has a molecular weight of 100,000 to 1,500,000. All percentages and proportions specified herein are by weight.

The content of water-soluble detersive surfaceactive agent may vary according to the particular use intended for the composition. A suitable hand dishwashing liquid may contain from 10 to 97%, preferably 15 to 45%, e.g., about 26% or 32% by weight of water-soluble detersive surface-active agent, preferably as a mixture of linear alkyl benzene sulphonate or alpha olefin sulphonate or sodium alkane sulphonate with some alkyl ether or alkylphenolether sulphate, possibly together with some alkyl amides or alkyl phenol ether amides or acyl ethanolamides of amine oxides.

If any alkyl substituted benzene sulfonate hydrotrope is present, any suitable weight may be employed, preferably from 0.5 to 6%, e.g., about 3%; and, when $C_2$–$C_3$ alkanols are employed, the proportion will be from 2% to 12%, preferably from about 3% to 8%, by weight. Normally the total content of adjuvants in the present compositions will be less than about 15% by weight thereof. Generally, no single adjuvant will be present to the extent of more than 5%, and preferably less than 3% of each will be utilized. None of the adjuvants or mixtures thereof should be present in an amount of detrimental to the desired performance of the compositions.

In the preferred liquid detergent compositions the viscosity will generally be in the range of 100 cps. to 300 cps (Brookfield viscometer with a #2 spindle at 20 rpm). Therefore, the proportion of the cationic polymer will be less than about 1.5% by weight as higher proportions significantly increase the viscosity of the liquid. Further, the pH in the preferred compositions will be from about 7 to about 8. Although lower pH's, such as about 5 or 6, may be employed, pH's above 8 should be avoided because the cationic resin is subject to chemical hydrolysis with its consequent adverse effects on the performance of the liquid compositions.

The invention may be performed in various ways and some specific Examples will be now described by way of illustration. All concentrations therein are set forth in weight percent unless otherwise stated. Example 1 does not embody the invention and is given to show the effect of the cationic polymer per se.

EXAMPLE 1

A glazed plate is washed for 30 seconds in a solution of polymer JR in water having a hardness of 300 ppm and at 40° C. The plate is at once left vertical to dry. The time necessary for the water to drain completely from the plate is recorded. The experiment is repeated on laboratory watch glasses. The results are given in Table II.

TABLE II

| Substrate | Polymer concentration | Draining time (seconds) | | |
|---|---|---|---|---|
| | | JR-125 | JR-400 | JR-30M |
| Watch-glass | 0.5% | 110 | 95 | 120 |
| " | 1.0% | 160 | 75 | 90 |
| " | 1.5% | 180 | 75 | 90 |
| Glazed plate | 0.5% | 120 | 65 | 75 |

On both watch-glasses and plates the best draining time is obtained with the JR-400 grade.

EXAMPLES 2–4

Three dishwashing detergent formulae with good cleaning and fast draining properties are given in Table III.

TABLE III

| Ingredient | Ex. 2 | Ex. 3 | Ex. 4 |
|---|---|---|---|
| $C_{14}$ – $C_{17}$ Na paraffin Sulphonate | 16 | 15 | 13 |
| $C_{12}$ – $C_{15}$ alcohol, (3 EO) $NH_4$ sulphate. | 16 | 11 | 13 |
| $C_9$ – $C_{11}$ alcohol (5EO) | — | 7 | 6 |
| Ethanol | 7 | 5 | 6 |
| Sodium xylene sulphonate | 3 | 3 | 3 |
| Polymer JR-400 | 0.6 | 0.5 | 0.4 |
| Adjuvants and water | QS | QS | QS |

After washing glass and glazed articles with the compositions of Examples 2 – 4 the washed surfaces are clean, shiny and spot-free, particularly when the articles are rinsed before drying.

EXAMPLE 5

A suitable commercial dishwashing liquid has the following composition:

| | |
|---|---|
| Sodium $C_{14}$ – $C_{17}$ paraffin sulfonate | 8 |
| Ammonium $C_{12}$ – $C_{15}$ alkyl triethenoxy ether sulfate | 16 |

-continued

| | |
|---|---|
| Sodium xylene sulfonate | 2.3 |
| Ethanol | 2.7 |
| Polymer JR-400 | 0.4 |
| Formaldehyde | 0.1 |
| Citric acid | 0.05 |
| Ascorbic acid | 0.01 |
| Perfume | 0.2–0.8 |
| Water | QS |
| | 100.0 |

This liquid detergent has a viscosity (Brookfield Viscometer) of about 200 cps. and glassware washed with an aqueous concentration containing 0.15% of this product have a substantially spot-free appearance after draining and drying at room temperature.

EXAMPLES 6 and 7

Other suitable dishwashing liquid detergents have compositions which follow:

| | 6 | 7 |
|---|---|---|
| Sodium $C_{14}-C_{17}$ paraffin sulfonate | 16 | 16 |
| Ammonium $C_{12}-C_{15}$ alkyl triethenoxy ether sulfate | 8 | 16 |
| Ethanol | 6 | 12 |
| Polymer JR-400 | 0.4 | 0.4 |
| Ethylenediamine tetra-acetate | 0.4 | 0.4 |
| Perservative, perfume, water | QS | QS |
| | 100.0 | 100.0 |

These compositions have a pH in the range of 6–8 and a viscosity (Brookfield Viscometer, #2 spindle at 20 rpm) in the range of 120–180 cps.

When Polymer JR-125 is substituted for Polymer JR-400 in the compositions of Examples 6 and 7, glassware and glazed plates washed in solutions of 0.05 to 0.5% by weight of such compositions and rinsed thereafter exhibit fast draining times.

Similar results are obtained when either sodium linear dodecylbenzene sulfonate or sodium $C_{14}$–$C_{16}$ olefin sulfonate detergent is substituted for the paraffin sulfonate detergent in the compositions of Examples 6 and 7.

EXAMPLE 8

Another acceptable liquid diswashing product follows:

| | |
|---|---|
| Sodium linear dodecylbenzene sulfonate | 18 |
| Ethoxylated nonyl phenol (9.5 EtO) | 6 |
| Sodium xylene sulfonate | 4 |
| Polymer JR-400 | 0.4 |
| Urea | 4 |
| Color (green) | 0.12 |
| Perfume | 0.25 |
| Water | QS |
| | 100.0 |

This product has a viscosity of 17° centipoises and leaves dishes washed in aqueous solutions of the composition with substantially spot free surfaces after rinsing and draining dry.

While the compositions, the cationic resin and the water soluble surface-active agent may be prepared by admixing the resin and the surface-active agent in any suitable manner, depending upon the final product form, e.g., particulate solid, tablet, liquid, etc., improved results are obtained when the resin is dissolved first in water. Suitable aqueous solutions of the cationic resin contain about 10% to 20% by weight of the resin and, preferably are prepared by dispersing the resin in water at a temperature of from 40° to 60° C with mild agitation. When formulating liquid compositions, the surface-active agent and adjuvants will be added to the aqueous resin with agitation; whereas the aqueous resin mixture usually will be blended with a surface-active agent or adjuvant in particulate form in the manufacture of solid compositions.

Although the present invention has been described with reference to particular embodiments and examples, it will be apparent to those skilled in the art that similar results may be obtained when used in combination with a wide variety of water soluble surface-active agents and adjuvants in addition to those specivfically described.

We claim:

1. A method of cleaning articles having soiled glazed surfaces which consists essentially of washing said articles in an aqueous medium having dissolved therein a mixture of a water-soluble, non-proteinaceous cationic polymer having the following structural formula:

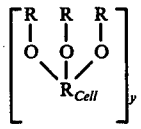

wherein $R_{Cell}$ is the residue of an anhydroglucose unit, y is an integer having a value of from 50 to 20,000, and each R individually represents a substituent group of the general formula:

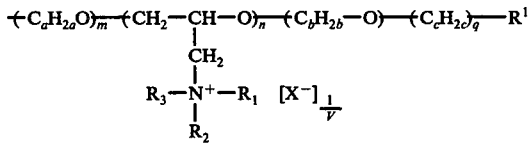

wherein *a* is 2 or 3; *b* is 2 or 3; *c* is 1, 2 or 3; *m* is 0 or an integer from 1 to 10; *n* is 0, 1, 2 or 3; *p* is 0 or an integer from 1 to 10; *q* is 0 or 1; R′ is -H,

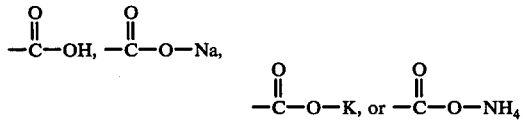

with the proviso that when q is 0 then R′ is -H;

$R_1$, $R_2$ and $R_3$ taken individually represent alkyl, aryl, aralkyl, alkaryl, cycloalkyl, alkoxyalkyl or alkoxyaryl radicals containing up to 10 carbon atoms, with the proviso that when any one of them is an alkoxyalkyl radical there are at least 2 carbon atoms separating the oxygen atom from the nitrogen atom, with the further proviso that the total number of carbon atoms in $R_1$, $R_2$ and $R_3$ is from 3 to 12 and with the further proviso that when $R_1$, $R_2$, and $R_3$ are taken together, the nitrogen atom to which $R_1$, $R_2$ and $R_3$ are attached can be a component of a heterocyclic ring selected from pyridine, α-methylpyridine, 2,5-dimethylpyridine, 2,4,6-trimethylpyridine, N-methylpiperidine, N-ethylpiperidine, N-methylmorpholine and N-ethylmorpholine;

X is an anion;

V is an integer which is equal to the valence of X; the average value of $n$ per anhydroglucose unit of said cellulose ether is from 0.01 to 1; and the average value of m+p+q per anhydroglucose unit of said cellulose ether is from 0.01 to 4, and a water-soluble surface active agent, the concentration of said surface active agent being about 0.01% to about 1% by weight and the weight ratio of said surface-active agent to said polymer being from about 2:1 to about 1000:1, and permitting said articles to drain.

2. A method in accordance with claim 1 wherein y has a value from about 200 to 5000, $R_1$, $R_2$ and $R_3$ are methyl and X is chloride.

3. A method in accordance with claim 2 wherein said washed articles are rinsed with water prior to permitting them to drain.

4. A method in accordance with claim 2 wherein said polymer is a cellulose ether derivative having a molecular weight in the range of 400,000 to 1,000,000 and said weight ratio of surface-active agent to polymer is from 15:1 to 100:1.

5. A method in accordance with claim 4 wherein said surface-active agent comprises an anionic sulfonated or sulfated detergent.

6. A method in accordance with claim 5 wherein said surface-active agent is a mixture of an anionic sulfonated detergent selected from the group consisting of $C_{10}$–$C_{16}$ alkyl benzene sulfonate, $C_{12}$–$C_{18}$ α olefin sulfonate and $C_{10}$–$C_{20}$ alkyl sulfonate and a second detergent selected from the group consisting of $C_{12}$–$C_{15}$ alkyl polyethenoxy ether sulfate containing 1 to 5 ethylene oxide groups, $C_8$–$C_{12}$ alkyl phenoxy polyethenoxy ether sulfate containing 1 to 6 ethylene oxide groups, condensation products of 5 to 30 moles of ethylene oxide with either $C_8$–$C_{15}$ alkanol or $C_8$–$C_{12}$ alkylphenol, and mixtures thereof, the weight ratio of sulfonated detergent to said second detergent being in the range of 1:4 to 4:1.

7. A liquid detergent composition adapted for washing articles having soiled glazed surfaces which are thereafter dried by draining which consists essentially of 15% to 45% by weight of a water-soluble surface active agent mixture of an anionic sulfonated detergent salt selected from the group consisting of $C_{10}$–$C_{16}$ alkyl benzene sulfonate, $C_{12}$–$C_{18}$ α olefin sulfonate and $C_{10}$–$C_{20}$ alkyl sulfonate and a second detergent which is a $C_{12}$–$C_{15}$ alkyl polyethenoxy ether sulfate containing 1 to 5 ethylene oxide groups, the weight ratio of sulfonate detergent to said second detergent being in the range of 1:4 to 4:1; about 0.05% to 5% by weight of a water-soluble non-proteinaceous, cationic polymer having the following structural formula

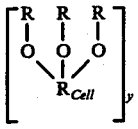

wherein $R_{Cell}$ is the residue of an anhydroglucose unit, $y$ is an integer having a value of from 50 to 20,000 and each R individually represents a substituent group of the general formula:

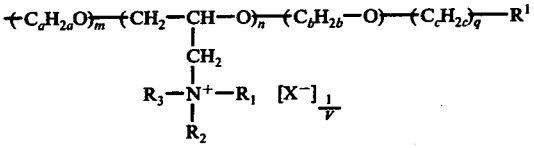

wherein $a$ is 2 or 3; $b$ is 2 or 3; $c$ is 1, 2 or 3; $m$ is 0 or an integer from 1 to 10; $n$ is 0, 1, 2 or 3; $p$ is 0 or an integer from 1 to 10; $q$ is 0 or 1;

R′ is -H,

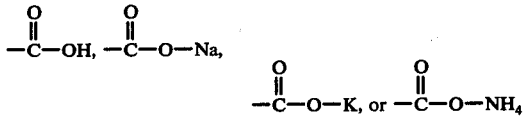

with the proviso that when $q$ is 0 or R′ is -H;

$R_1$, $R_2$ and $R_3$ taken individually represent alkyl, aryl, aralkyl, alkaryl, cycloalkyl, alkoxyalkyl or alkoxyaryl radicals containing up to 10 carbon atoms, with the proviso that when any one of them is an alkoxyalkyl radical there are at least 2 carbon atoms separating the oxygen atom from the nitrogen atom, with the further proviso that the total number of carbon atoms is $R_1$, $R_2$ and $R_3$ is from 3 to 12 and with the further proviso that when $R_1$, $R_2$, and $R_3$ are taken together, the nitrogen atom to which $R_1$, $R_2$ and $R_3$ are attached can be a component of a hetercyclic ring selected from pyridine, α-methylpyridine, 2,5-dimethylpyridine, 2,4,6-trimethylpyridine, N-methylpiperidine, N-ethylpiperidine, N-methylmorpholine and N-ethylmorpholine;

X is an anion;

V is an integer which is equal to the valence of X; the average value of $n$ per anhydroglucose unit of said cellulose ether is from 0.01 to 1; and the average of $m+p+q$ per anhydroglucose unit of said cellulose ether is from 0.01 to 4, the weight ratio of said surface-active agent mixture to polymer being from about 2:1 to about 1000:1; and an aqueous medium containing from 0% to 12% by weight of a $C_2$–$C_3$ alkanol.

8. A composition in accordance with claim 7 wherein $y$ has a value of from about 200 to about 5000, $R_1$, $R_2$ and $R_3$ are methyl and X is chloride.

9. A liquid detergent composition in accordance with claim 6 wherein said polymer is a cellulose ether derivative having a molecular weight in the range of 400,000 to 1,000,000 and said weight ratio of surface-active agent mixture to polymer is from 15:1 to 100:1.

10. A liquid detergent composition in accordance with claim 9 wherein said ratio of sulfonated detergent to said second detergent is from 1:2 to 2:1 and said alkanol is present in an amount of from 2% to 12% by weight.

11. A liquid detergent composition in accordance with claim 10 wherein said sulfate detergent is a major proportion of said detergent mixture.

12. A liquid detergent composition in accordance with claim 9 wherein said alkanol is present in an amount from 2% to 12% by weight and which contains in addition from 0.5% to 6% by weight of an alkyl-substituted, benzene sulfonate hydrotrope.

* * * * *